US005934603A

United States Patent [19]

Cole et al.

[11] Patent Number: 5,934,603

[45] Date of Patent: Aug. 10, 1999

[54] SURFACE WINDER UNDERCUT DRIVE ROLLER APPARATUS AND METHOD

[75] Inventors: Kevin A. Cole, Ontario; Sharon A. Guzman, Kent; Larry Thomas Shafer, Rochester, all of N.Y.

[73] Assignee: Eastman Kodak Company, Rochester, N.Y.

[21] Appl. No.: 09/014,061

[22] Filed: Jan. 27, 1998

Related U.S. Application Data

[63] Continuation of application No. 08/659,793, Jun. 6, 1996, abandoned.

[51] Int. Cl.[6] ..... B65H 18/10; B65H 18/16

[52] U.S. Cl. ..... 242/542.4; 242/547

[58] Field of Search ..... 242/541.5, 542.4, 242/547; 492/38, 39

[56] References Cited

U.S. PATENT DOCUMENTS

| | | | |
|---|---|---|---|
| 2,184,003 | 12/1939 | Parker et al. . | |
| 2,353,044 | 7/1944 | Kriegsheim . | |
| 2,877,957 | 3/1959 | Hyman . | |
| 2,985,398 | 5/1961 | Rockstrom et al. . | |
| 3,039,710 | 6/1962 | Walter . | |
| 3,057,573 | 10/1962 | Kindig et al. . | |
| 3,737,030 | 6/1973 | Stewart . | |
| 3,834,637 | 9/1974 | Reed | 242/542.4 |
| 4,150,886 | 4/1979 | Merkel et al. . | |
| 4,304,368 | 12/1981 | Bartmann . | |
| 4,343,440 | 8/1982 | Engl . | |
| 4,588,138 | 5/1986 | Spencer . | |
| 4,641,939 | 2/1987 | Kitner . | |
| 4,830,303 | 5/1989 | Hagens et al. . | |
| 4,832,274 | 5/1989 | Hawkins | 242/542.4 |
| 4,877,196 | 10/1989 | Heymanns . | |
| 4,933,716 | 6/1990 | Imamura et al. . | |
| 4,934,622 | 6/1990 | Hakiel . | |
| 5,039,023 | 8/1991 | Hagens et al. . | |
| 5,152,474 | 10/1992 | Hicks . | |
| 5,518,201 | 5/1996 | Hagens et al. | 242/547 |
| 5,553,806 | 9/1996 | Lucas . | |
| 5,582,361 | 12/1996 | Muller et al. | 242/542.4 |

FOREIGN PATENT DOCUMENTS

| | | |
|---|---|---|
| 56-17846 | 2/1981 | Japan . |
| 63-258350 | 10/1988 | Japan . |

*Primary Examiner*—John P. Darling
*Attorney, Agent, or Firm*—Susan L. Patrick

[57] ABSTRACT

A surface winder having an undercut drive roller. An apparatus for winding web material onto a core includes a driven pressure roller having a first end portion, a second end portion, and a central portion intermediate the first and second end portions. When the pressure roller is driven against the core, a first and second nip is formed between the first and second end portions, respectively, and the core. The central portion is undercut so as to space the central portion from the web material being wound onto the core.

13 Claims, 3 Drawing Sheets

SURFACE WINDER UNDERCUT DRIVE ROLLER APPARATUS AND METHOD

THIS APPLICATION IS A CONTINUATION OF U.S. Ser. No. 08/659,793 FILED JUN. 6, 1996, now abandoned.

FIELD OF THE INVENTION

The present invention relates to the winding of a web material onto a core. More particularly, the present invention relates to an apparatus and method for winding a web material onto a core wherein the resulting wound roll is free of defects.

BACKGROUND OF THE INVENTION

During the manufacturing of web material, the web material may be conveyed from one location to another to process the web. For example, a coating may be applied to the web material as it is conveyed. In addition, the manufacturing of the web material may include a winding operation. For example, the web material may be unwound from a core to apply a coating to the web material, and, after the coating is applied, the web material may be re-wound back onto the core. The operations of conveying and winding of a web material may occur several times during manufacturing.

Apparatus and methods are known for conveying web material. U.S. Pat. No. 4,933,716 (Imamura et al) teaches a film carrier used for printing an image onto a light sensitive material. Conveying rollers 22,24 are arranged to transport the film. The conveying rollers are provided with large diameter contact sections for contacting both edge regions of the film. U.S. Pat. No. 4,641,939 (Kitner) relates to an automatic film threading apparatus wherein a pinch roller 16 and a powered film spool 52 grip and pull the edges of a threading leader assembly 15 to convey the film. The pinch roller has an upper and lower concave shape with the edges of the roller having a flat circumferential surface. U.S. Pat. No. 4,150,886 (Merkel et al) discloses a motion picture projection system comprising a capstan and pinch roller designed to eliminate the creeping of the film from between the capstan and pinch roller. The capstan's frictional surfaces are inclined inwardly, while the pinch roller's end frictional surfaces are frusto-conical and inclined inwardly in the opposite directions.

Apparatus and methods for winding web material differ from the apparatus and methods for conveying web material. If the web material is not wound properly, defects such as pressure marks and scratches can result, making the web material unsuitable for finished product. To produce a good quality wound roll by winding, a uniform hardness is preferred. To achieve the desired hardness, a known method is to provide a rider roller or pressure roller which presses against the outer circumference of the roll being wound, thereby providing a constant hardness-controlling linear pressure. Referring to FIGS. 1*a* and 1*b*, a web 10 of material is being wound onto a core 12, forming a wound roll 14 of web material. A contact roller or pressure roller 16 is in contact with roll 14 across the width of web 10. A force F biases pressure roller 16 toward roll 14 such that a zone of contact or nip 18 is formed between pressure roller 16 and wound roll 14. Such a biasing force F may be accomplished by mounting pressure roller 16 on a pivotable mechanism or slider mechanism. In operation, web material 10 is held in tension T as it is transported about a portion of pressure roller 16 and through nip 18 onto core 12. As illustrated in FIG. 1*a*, pressure roller 16 is being driven by a motor 20 (as shown by arrow A) while core 12 is free to rotate; such a configuration is generally referred to as a surface winder. In contrast, in FIG. 1*b* core 12 is driven by motor 20 (as shown by arrow A) while pressure roller 16 is free to rotate. This configuration is generally referred to as pressure roller assisted center winding.

Air entrainment occurs when a layer of air moving with the web becomes wound into the roll, particularly during high speed winding. The pressure roller is intended to reduce the amount of air which is wound or entrained into the wound roll, thus the pressure roller contacts the web material across its entire width. If the amount of entrained air is substantial, a lap of wound web may not make contact with a previous lap, and the newly wound lap may shift or move relative to the previous lap causing abrasions in the web material.

While a pressure roller may assist in the reduction of entrained air, high contact stresses can occur as a result of a high contact force between the pressure roller and the wound roll. Stress risers, such as areas of increased web thickness and the presence of dirt or other particulate material, can also increase the contact stress. These high contact stresses can cause pressure marks in the web material, thereby adversely affecting the web material. In a particular situation wherein the web material is photosensitive, one side of the web material may be coated with carbon black particles, which reduce light reflections during exposure of the photosensitive web. High pressures from the pressure roller may cause the transfer of these carbon black particles onto the underlying lap of web wound onto the roll, causing what is referred to as low density spots which adversely affect the image of the photosensitive material. In addition, nonuniformities across the width of the web, such as material thickness and material property nonuniformity, cause contact stresses to be concentrated in particular locations across the web width. This non-uniformity of contact stresses unbalances the web tension forces during winding, causing lap-to-lap shifting and resulting in abrasions. Yet a further problem encountered during winding is lack of sidewall straightness. Air entrainment is a contributor to sidewall nonstraightness, as is web thickness nonuniformity and material property nonuniformity.

Pressure roller assisted center winding, described above, is unsuitable for high speed winding applications having a large build-up ratio. That is, where the ratio of the wound roll diameter to the core diameter is high. With such a center winding configuration, the torque applied to the core to drive the wound roll must be transmitted through the entire wound roll. This can cause the roll to cinch, resulting in abrasions to the web material. To avoid cinching, the wound roll hardness should be high. However, to achieve hard roll conditions, high stresses and their associated adverse effects, as described above, may occur.

U.S. Pat. No. 4,877,196 (Heymanns) relates to a rider roller for use in a web winding machine. The rider roller comprises grooves arranged in its surface to facilitate the transport of entrained air to avoid puckers and wrinkles. Such pressure rollers may be unsuitable for web material coated with photosensitive material, such as 35 mm consumer film or motion picture film. Photosensitive web material is sensitive to pressure marks, low density spots, and scratches which can occur by the riding of the pressure roller on the wound roll of photosensitive material. If located within the image area of the photosensitive material, pressure marks, low density spots, and scratches can cause the web material to be unsuitable for salable product.

U.S. Pat. No. 2,877,957 (Hyman) discloses a nondriven pressure roller in a pressure roller assisted center winding configuration. The pressure roller has a metal surface which is stepped in profile to guide webs of differing widths onto a winding roll. As previously described, this winding configuration is unsuitable for high speed applications wherein the build-up ratio is high since a torque is applied through the winding roll. Further, for surface winding, the metal surfaces of Hyman are unsuitable for high speed winding of photosensitive web material since the metal can cause high contact stresses and provides inadequate traction capability for winding.

U.S. Pat. No. 2,353,044 (Kriegsheim) relates to a film magazine wherein the film on a delivery roll is wound on a take-up spool after being exposed. An arrangement of rollers are positioned against the delivery roll and the take-up roll to prevent uncoiling and provide tight winding. This winding configuration may be suitable for slow, intermittent winding onto the take-up roll, however, such a configuration is not suitable for continuous, high speed winding, for example, at 100 feet per minute or greater. Further, the roller arrangement is unsuitable for surface winding applications where adequate traction must be developed to prevent the pressure roller from scratching the web material.

In many situations, rolls are started by first detaching the web material from the pressure roller and then winding, by hand, several laps onto the core. If the web material is photosensitive, this starting procedure is conducted in low or non-light conditions. Accordingly, a winding apparatus and method should be conducive to starting the winding of a new wound roll in non-light conditions to improve the efficiency of the winding operation.

Accordingly, there exists a need for an apparatus and method for winding web material onto a core wherein air entrainment is reduced, a good quality wound roll is produced, and defects, such as pressure marks and scratching, are not introduced to the roll. Such an apparatus and method should be appropriate for photosensitive web material, suitable for imperfect web material (i.e., non-flat web material, non-uniform thickness), applicable to high speed winding applications, and minimize the difficulty in starting a new wound roll.

SUMMARY OF THE INVENTION

An object of the invention is to provide an apparatus and method for winding web material onto a core wherein air entrainment is reduced, a good quality wound roll is produced, and defects are not introduced to the web material.

Another object of the invention is to provide such an apparatus and method suitable for winding photosensitive web material.

A further object of the invention is to provide such an apparatus and method which can be utilized in high speed winding applications.

Still another object of the invention is to provide such an apparatus and method wherein imperfect web material can be accommodated.

Yet a further object of the invention is to provide such an apparatus and method which minimizes the difficulty in starting the winding of a new wound roll.

These objects are given only by way of illustrative example. Thus, other desirable objectives and advantages inherently achieved by the disclosed invention may occur or become apparent to those skilled in the art. The invention is defined by the appended claims.

According to one aspect of the invention, there is provided an apparatus for winding a web of material. The apparatus includes a core about which the web material is wound, the core being freely rotatable about an axis. The apparatus also includes a roller mounted for rotation about an axis substantially parallel to the axis of the core, the roller having first and second ends. The roller has first and second end portions located at the first and second ends, respectively, and a central portion intermediate the first and second end portions. Urging means are provided to urge contact between the roller and the core to form a first nip area between the first end portion and the core and a second nip area between the second end portion and the core. Driving means drive the roller to transport the web through the first and second nip to wind the web on the core whereby the web contacts the first and second end portions but is spaced apart from the central portion.

According to another aspect of the invention, there is provided an apparatus for winding a web of photosensitive material, the web material having an image and a non-image area. The apparatus includes a core about which the web material is wound, the core being freely rotatable about an axis. The apparatus also includes a roller mounted for rotation about an axis substantially parallel to the axis of the core, the roller having first and second ends. The roller has compliant first and second end portions located at the first and second ends, respectively, and a central portion intermediate the first and second end portions. Urging means are provided to urge contact between the roller and the core to form a first nip area between the first end portion and the core and a second nip area between the second end portion and the core. Driving means drive the roller to transport the web through the first and second nip to wind the web on the core whereby the first and second end portions contact the non-image area of the web while not contacting the image area of the web. The central portion is spaced from the web so as to not contact the image and non-image areas of the web.

According to another aspect of the invention, there is provided a method of winding a web of material on a core. A roller, having first and second ends, is mounted for rotation about an axis. First and second end portions of the roller are located at the first and second ends, respectively, with a central portion positioned intermediate the first and second end portions. The core is mounted for free rotation about an axis substantially parallel to the axis of the roller. The roller and core are urged into contact, forming a first nip between the first end portion and the core and forming a second nip between the second end portion and the core. The roller is driven to transport the web through the first and second nip to wind the web on the core whereby the web contacts the first and second end portions while the central portion is spaced from the core and the web so as to not contact the core and the web.

According to a further aspect of the invention, there is provided a method of winding a web of photosensitive material on a core wherein the web material has an image and a non-image area. A roller, having first and second ends, is mounted for rotation about an axis. First and second end portions of the roller are located at the first and second ends, respectively, with a central portion positioned intermediate the first and second end portions. The core is mounted for free rotation about an axis substantially parallel to the axis of the roller. The roller and core are urged into contact, forming a first nip between the first end portion and the core and forming a second nip between the second end portion and the core. The roller is driven to transport the web through the first and second nip to wind the web on the core whereby the first and second end portions contact the non-image area of the web while not contacting the image area of the web. The central portion is spaced from the web so as to not contact the image and non-image areas of the web.

The present invention provides an apparatus and method for winding web material onto a core wherein air entrainment is reduced, a good quality wound roll is produced, and defects, such as pressure marks and scratching, are not introduced to the roll. The apparatus and method are appropriate for photosensitive web material, suitable for imperfect web material, applicable to high speed winding applications, and minimize the difficulty in starting a new wound roll.

BRIEF DESCRIPTION OF THE DRAWINGS

The foregoing and other objects, features, and advantages of the invention will be apparent from the following more particular description of the preferred embodiments of the invention, as illustrated in the accompanying drawings.

DETAILED DESCRIPTION OF THE INVENTION

Figure 1A:
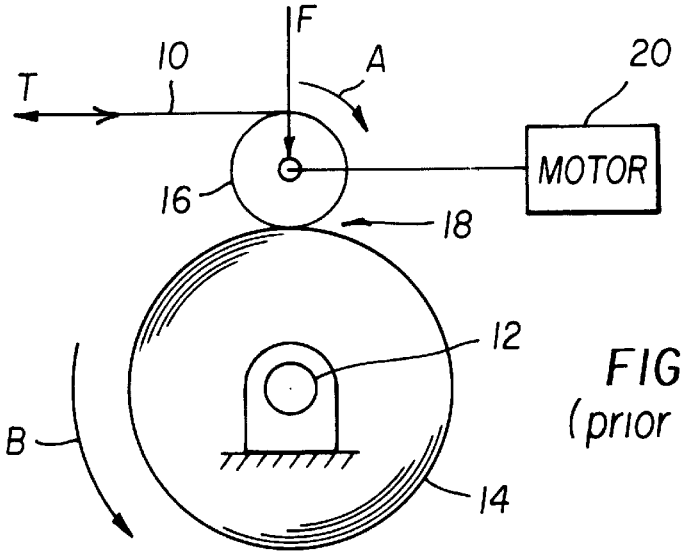
FIG. 1a (prior art)
FIG. 1*a* and 1*b* shows a prior art surface winding configuration and center winding configuration.
Figure 1B:
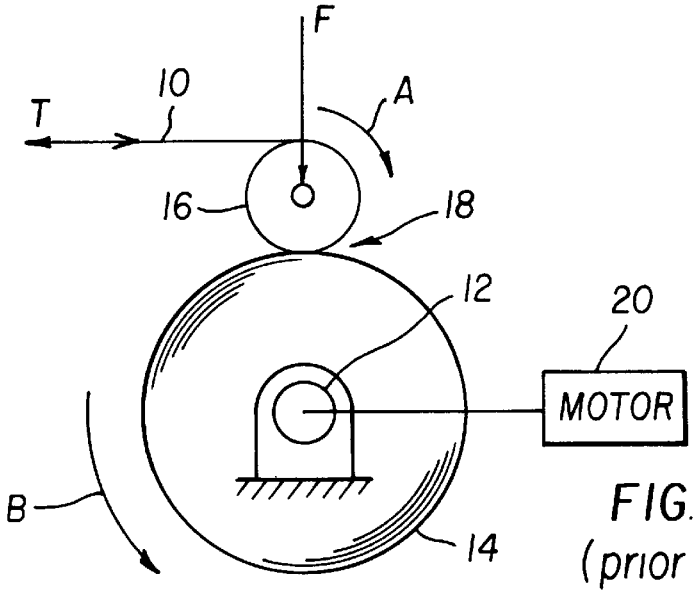
FIG. 1b (prior art)

The following is a detailed description of the preferred embodiments of the invention, reference being made to the drawings in which the same reference numerals identify the same elements of structure in each of the several figures.

Surface winding is a suitable method for high speed applications wherein the ratio of the wound roll diameter to the core diameter is high. The present invention employs a surface winding configuration, as illustrated in FIG. 1*a*. As illustrated, web 10 is being wound onto core 12, forming a wound roll 14 of web material. Pressure roller 16 is in contact with roll 14 across the width of web 10. Force F biases pressure roller 16 toward roll 14 such that nip 18 is formed between pressure roller 16 and wound roll 14. Such a biasing force F may be accomplished by mounting pressure roller 16 on a pivotable mechanism or slider mechanism. As illustrated, pressure roller 16 is being driven by motor 20 while core 12 is free to rotate about a fixed center. Since pressure roller 16 is driven, it may also be referred to as a drive drum or drive roller. In operation, web material 10 is held in tension T as it is transported about a portion of pressure roller 16 and through nip 18 onto core 12. Motor 20 drives pressure roller 16, and the friction force between web material 10 and wound roll 14 causes wound roll 14 to rotate at the speed of the moving web in a direction shown by arrow B. Wound roll 14 does not need to transmit the torque induced by the web tension T since the friction between web material 10 and wound roll 14 carries the tension.

In an alternate embodiment, pressure roller 16 may be mounted on a fixed center and core 12 may be biased toward pressure roller 16, such as by a pivot mechanism or slider mechanism. This embodiment provides an alternate method for accommodating the change in the wound roll diameter as the web material is wound onto the roll.

This winding configuration reduces the amount of air which is wound or entrained into wound roll 14. By reducing the amount of entrained air, wound roll 14 can be wound tighter, i.e., to a higher level of in-roll pressure, thereby improving the wound roll integrity. If the force F exerted by pressure roller 16 on wound roll 14 is too high, pressure marks may occur due to the presence of high contact stress, particularly if web material 10 is photosensitive.

Figure 2:
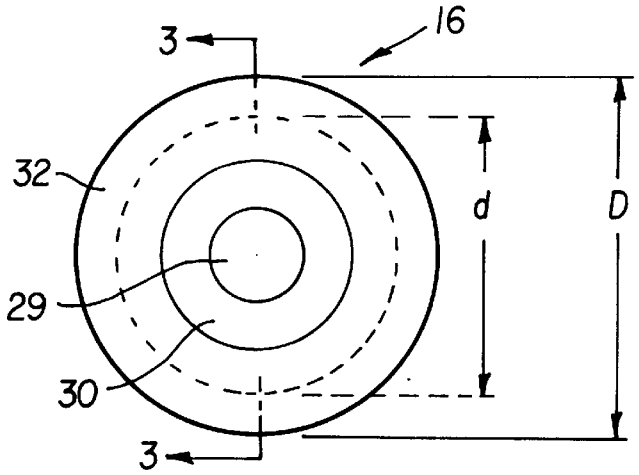
FIG. 2 shows a side view of a first embodiment of a drive roller or pressure roller in accordance with the present invention.
Figure 3:
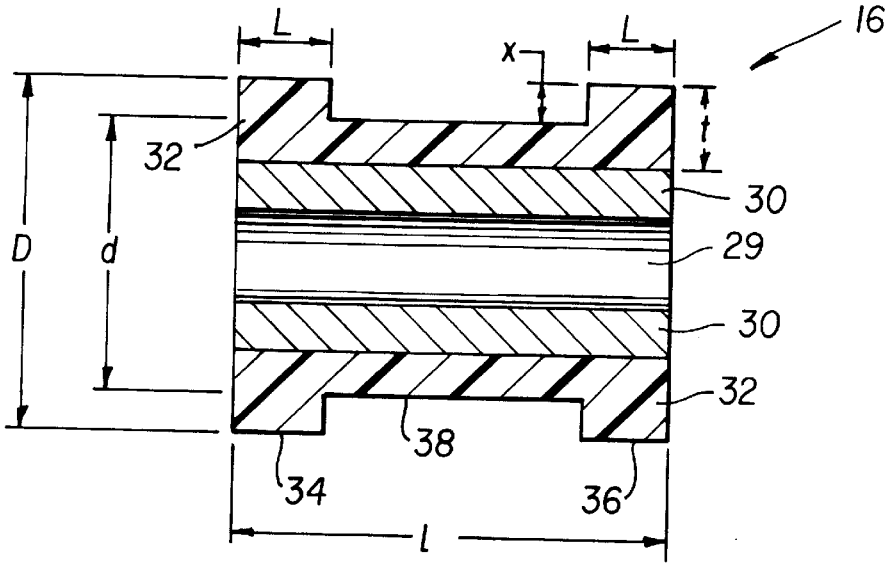
FIG. 3 shows a cross sectional view along line 3—3 of FIG. 2.

Accordingly, the present invention employs a pressure roller having an undercut, or alternately stated, a variable radial profile along its longitudinal length. Illustrated in FIGS. 2 and 3 is a pressure roller 16, in accordance with the present invention, having a length l. Pressure roller 16 comprises a hollow opening 29 and a rigid support member 30, for example made of metal or the like, able to accommodate high stresses without bending or deflecting. A sleeve 32 is supported over its entire length by support member 30. Sleeve 32 may be attached to support member 30 by means known to those skilled in the art, such as by casting or mechanical attachment. Alternately, sleeve 32 may be formed as a sheath which is slipped over support member 30, such as by pressurized air, and then optionally secured to support member 30, for example, by adhesive. Sleeve 32 is preferably comprised of a resilient or elastomeric material such as polyurethane or urethane, with a hardness in the range of about 40 to about 80 durometer Shore A or equivalent, preferably about 50 to about 70 durometer Shore A. This material selection provides suitable frictional capability to overcome the winding tension and drive the wound roll without slippage. This material selection further provides suitable compliance so that the contact stresses are not sufficiently high whereby pressure marks on the web material would form.

Sleeve 32 includes first end portion 34, a second end portion 36, and a central portion 38 intermediate first and second portions 34,36. First and second end portions 34,36 are cylindrical, each having a substantially equal outer diameter D, a thickness t, and a length L. Central portion 38 is also cylindrical, and has an outer diameter d which is less than the outer diameter D of first and second end portions 34,36. While FIG. 3 shows the length L of the first and second end portions to be substantially equal, the length L of first end portion 34 need not be substantially equal to the length L of second end portion 36.

Figure 4:
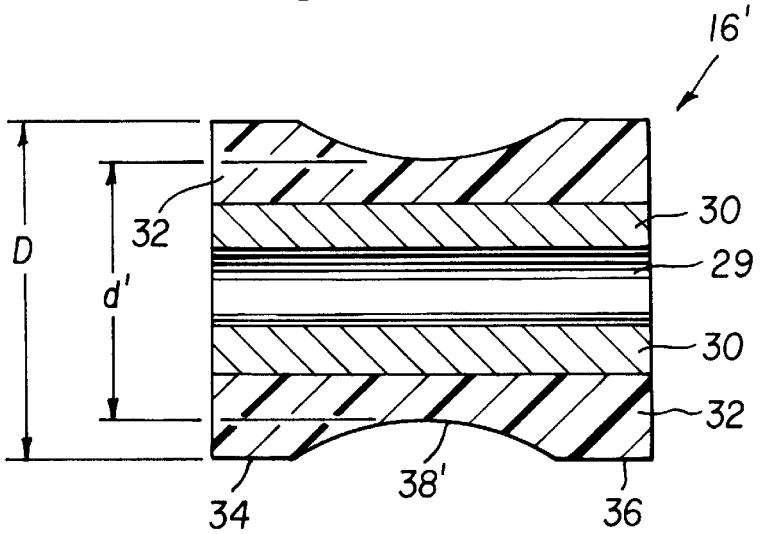
FIG. 4 shows a cross sectional view of a second embodiment of a drive roller in accordance with the present invention.
Figure 5:
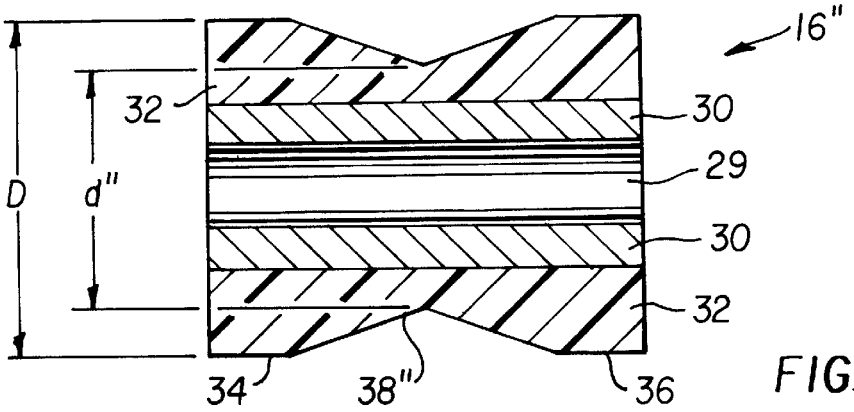
FIG. 5 shows a cross sectional view of a third embodiment of a drive roller in accordance with the present invention.

As illustrated in FIGS. 2 and 3, the outer diameter d of central portion 38 is a constant. Accordingly, the undercut of the pressure roller has a dimension x, as illustrated in FIG. 3, equal to (D−d)/2. FIGS. 4 and 5 illustrate alternate embodiments of a pressure roller in accordance with the present invention. FIG. 4 shows pressure roller 16' having a central portion 38' having a varying radius, specifically, a curved radial profile, having a minimum outer diameter d'. FIG. 5 shows pressure roller 16" with a central portion 38" having a linearly varying radius, with a minimum outer diameter d". Other profiles for central portion 38 may be suitable. The undercut dimension for the embodiment illustrated in FIGS. 4 and 5 varies because of the varying radial profile. However, the maximum undercut dimension for these two illustrated embodiments can be calculated from the equation (D-d)/2.

Figure 6:
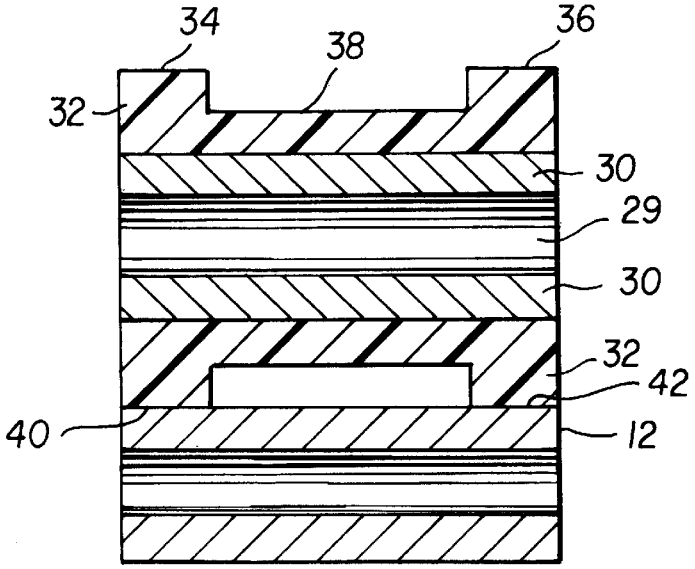
FIG. 6 shows a cross sectional view of a drive roller and core.

In operation, when pressure roller 16 and core 12 are mounted on a substantially parallel axis, and pressure roller 16 is urged to contact core 12 (e.g., by biasing pressure roller 16 toward core 12), a nip is formed between the pressure roller and the core. More specifically, referring to FIG. 6, a first nip 40 is formed between first end portion 34 and core 12, and a second nip 42 is formed between second end portion 36 and core 12. No nip is formed between central portion 38 and core 12; central portion 38 is spaced from core 12 such that no contact is made between central portion 38 and core 12 (or web material 10 when the web is wound onto the core). The length I of pressure roller 16 may vary. That is, the length l of the pressure roller may be greater than the width of the web, as long as the first and second nip are formed. Similarly, the length l of the pressure roller may be less than the width of the web whereby the first and second nip are formed, however, the central portion is to be spaced from the portion of the web which is to be free of defects. For a stable winding condition, the length l of the pressure roller is preferably substantially equal to the width of the web material being wound onto the core, particularly if a flange on the core or pressure roller is incorporated to reduce sidewall nonstraightness.

Figure 7:
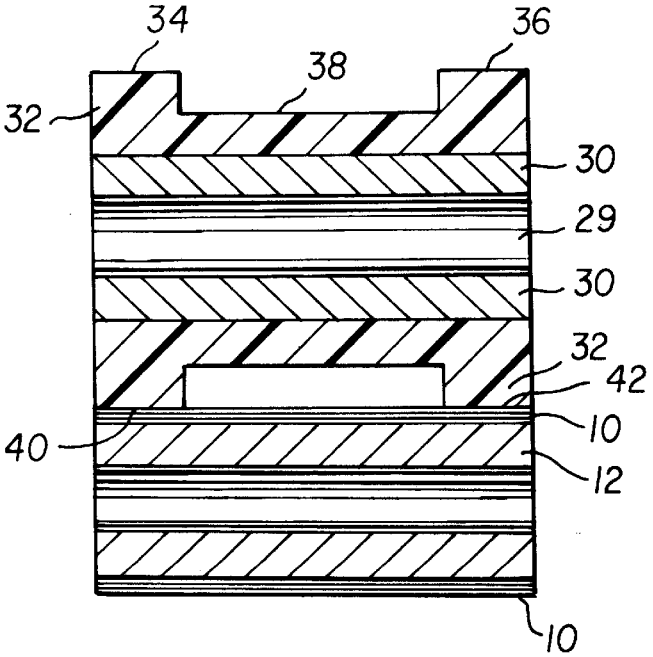
FIG. 7 shows a cross sectional view of a drive roller and web material wound onto a core.

When pressure roller 16 is driven, web 10 is transported about a portion of the pressure roller, wherein web 10 abuts first and second end portions 34,36, but does not contact central portion 38. Web 10 then enters first and second nips 40,42 and is wound onto core 12. Referring now to FIG. 7, as web material 10 is wound onto core 12, first and second end portions 34,36 contact the wound laps of web on wound roll 14, while central portion 38 is spaced from web 10.

As indicated, web 10 is transported about a portion of the pressure roller. This wrap of web 10 around pressure roller 16 can range between 0 and 180 degrees. FIG. 1*a* illustrates a wrap angle of web 10 about pressure roller 16 of approximately 180 degrees. If the wrap angle is 0 degrees, web 10 would enter nip 18 directly.

Figure 8:
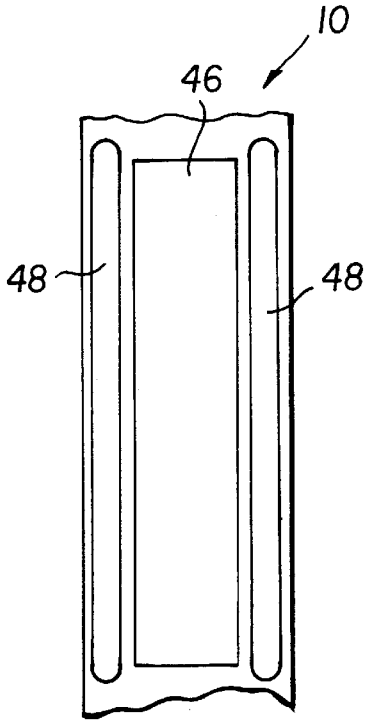
FIG. 8 shows a portion of web material illustrating image areas and non-image areas.

If web material 10 is a photosensitive web material, web material 10 includes an image area 46 and non-image areas 48, as shown in FIG. 8. As such, when web material 10 is transported through first and second nips 40,42, non-image area 48 contacts first and second end portions 34,36, but not image area 46. Rather image area 46 is spaced from both first and second end portions 34,36 and central portion 38. Accordingly, the occurrence of pressure marks or low density in the image area will be reduced or eliminated. Since first and second end portions 34,36 contact the non-image areas 48 of web material 10 while not contacting image area 46, the dimension of first and second end portions 34,36 along the longitudinal dimension of pressure roller 16 are dependent on the size of image area 46 and non-image areas 48 of the web material.

The undercut dimension of the pressure roller can vary so long as central portion 38 remains spaced from the web material during operation. In determining a minimum value of the undercut dimension, the amount of compression of the pressure roller material, the non-uniformity of the web material being wound, and the wear characteristics of the pressure roller material are items to be considered. If the undercut dimension is too small, the central portion will contact the web material. In determining a maximum value of the undercut dimension, structural stability of the first and second end portions should be considered. If the undercut dimension is too large, air entrainment can occur, decreasing the roll hardness and adversely affecting the roll integrity. Preferably, the aspect ratio between the length L of the first or second end portions and the undercut dimension x is not less than 2:1. That is, preferably the undercut dimension x is less than or equal to one-half the length L of the first or second end portions.

For FIG. 3, since the undercut dimension x is equal to (D-d)/2, and preferably x is less than or equal to one-half of L, it follows that (D-d) is preferably less than or equal to L.

FIGS. 2 and 3 illustrate the preferred embodiment wherein the difference in the diameter D of end portions 34,36 and diameter d of central portion 38 is from about 0.020 to about 0.040 inches. The thickness t of end portions 34,36 can range from about 0.093 inches to about 0.250 inches, preferably 0.125 inches. Applicants note that it is preferable that the longitudinal dimension of central portion 38 be a ratio of about 0.67 of the total longitudinal dimension of sleeve 32, though reliable performance has been achieved for a ratio ranging from about 0.25 to about 0.85.

The present invention facilitates the method used to start a new wound roll. Currently, locating the lead edge of the web material is cumbersome due to low light conditions and a generally high level of tackiness of the pressure roller. The undercut, i.e., central portion 38, provides a physical, convenient location for an operator to grasp the web to locate the leading edge of the web material. The undercut portion (i.e., central portion 38) allows an operator to find the web material by the sense of touch, thereby readily starting the winding of a new wound roll in low or non-light conditions.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

| PARTS LIST |
|---|
| 10 web material |
| 12 core |
| 14 wound roll |
| 16 pressure roller |
| 18 nip |
| 20 motor |
| 29 hollow opening |
| 30 support member |
| 32 sleeve |
| 34 first end portion |
| 36 second end portion |
| 38 central portion |
| 40 first nip |
| 42 second nip |
| 46 image area of web |
| 48 non-image area of web |

What is claimed is:

1. A web winding apparatus for winding a web of material, comprising:

a core about which the web material is wound, said core being freely rotatable about an axis;

a roller mounted for rotation about an axis substantially parallel to said axis of said core, said roller having first and second axial ends, said roller including first and second end portions located at said first and second axial ends, respectively, and a central portion intermediate said first and second end portions, said first and second end portions having a first outer diameter D, said central portion having a second outer diameter d less than said first outer diameter D, a difference between said first outer diameter D and said second outer diameter d is in the range from about 0.020 to about 0.040 inches, said first and second end portions being comprised of a resilient outer layer supported on a rigid support member;

urging means for urging contact between said roller and said core;

a first nip area formed by said first end portion and said core;

a second nip area formed by said second end portion and said core; and driving means for driving said roller to transport the web through said first and second nips to wind the web on said core such that the web contacts said first and second end portions and the web is spaced apart from said central portion.

2. A web winding apparatus for winding a web of material, comprising:

a core about which the web material is wound, said core being freely rotatable about an axis;

a roller mounted for rotation about an axis substantially parallel to said axis of said core, said roller having first and second axial ends and a longitudinal length directed along said axis of said roller, said roller including first and second end portions located at said first and second axial ends, respectively, and a central portion intermediate said first and second end portions, said first and second end portions having a first outer diameter D, said central portion having a second outer diameter d less than said first outer diameter D, said central portion having a radial profile which varies continuously along the longitudinal length, the diameter of said central portion varying continuously between a maximum diameter substantially equal to said first outer diameter and a minimum diameter substantially equal to said second outer diameter d, said first and second end portions being comprised of a resilient outer layer supported on a rigid support member;

urging means for urging contact between said roller and said core;

a first nip area formed by said first end portion and said core;

a second nip area formed by said second end portion and said core; and driving means for driving said roller to transport the web through said first and second nips to wind the web on said core such that the web contacts said first and second end portions and the web is spaced apart from said central portion.

3. The apparatus according to claim 2 wherein said central portion has a non-linearly varying radial profile extending along the longitudinal length.

4. The apparatus according to claim 2 wherein said central portion varies in diameter linearly along the longitudinal length.

5. A web winding apparatus for winding a web of material, comprising:

a core about which the web material is wound, said core being freely rotatable about an axis;

a roller mounted for rotation about an axis substantially parallel to said axis of said core, said roller having first and second axial ends, said roller including first and second end portions located at said first and second axial ends, respectively, and a central portion intermediate said first and second end portions, said first and second end portions having a first outer diameter D, said central portion having a second outer diameter d less than said first outer diameter D, said first and second end portions being comprised of a resilient outer layer supported on a rigid support member, said roller having a length directed along said axis of said roller, and said central portion having a length directed along said axis of said roller, a ratio of said central portion length to said roller length being between about 0.65 and about 0.69;

urging means for urging contact between said roller and said core;

a first nip area formed by said first end portion and said core;

a second nip area formed by said second end portion and said core; and driving means for driving said roller to transport the web through said first and second nips to wind the web on said core such that the web contacts said first and second end portions and the web is spaced apart from said central portion.

6. A web winding apparatus for winding a web of photosensitive material, the web material having an image area and a non-image area, comprising:

a core about which the web material is wound, said core being freely rotatable about an axis;

a roller mounted for rotation about an axis substantially parallel to said axis of said core, said roller having first and second axial ends, said roller including first and second end portions located at said first and second axial ends, respectively, and a central portion intermediate said first and second end portions, said first and second end portions having a first outer diameter D, said central portion having a second outer diameter d less than said first outer diameter D, said first and second end portions being comprised of a resilient outer layer supported on a rigid support member, said resilient outer layer having a hardness of about 50 to about 70 durometer Shore A, said roller having a length directed along said axis of said roller, said central portion having a length directed along said axis of said roller, and a ratio of said central portion length to said roller length being between a bout 0.65 an d about 0.69;

urging means for urging contact between said roller and said core;

a first nip area formed by said first end portion and said core;

a second nip area formed by said second end portion and said core; and driving means for driving said roller to transport the web through said first and second nips to wind the web on said core such t hat said first and second end portions contact the non-image area of the web while not contacting the image area of the web, said central portion being spaced from the web so as to not contact the image and non-image areas of the web.

7. A web winding apparatus for winding a web of photosensitive material, the web material having an image area and a non-image area, comprising:

a core about which the web material is wound, said core being freely rotatable about an axis;

a roller mounted for rotation about an axis substantially parallel to said axis of said core, said roller having first and second axial ends, said roller including first and second end portions located at said first and second axial ends, respectively, and a central portion intermediate said first and second end portions, said first and second end portions having a first outer diameter D, said central portion having a second outer diameter d less than said first outer diameter D, said first and second end portions being comprised of a resilient outer layer supported on a rigid support member, said resilient outer layer having a hardness of about 50 to about 70 durometer Shore A, said central portion having a length directed along said axis of said roller, said central portion having a varying radial profile along the length, a ratio of said central portion length to said roller longitudinal length being between about 0.65 and about 0.69;

urging means for urging contact between said roller and said core;

a first nip area formed by said first end portion and said core;

a second nip area formed by said second end portion and said core; and driving means for driving said roller to transport the web through said first and second nips to wind the web on said core such that said first and second end portions contact the non-image area of the web while not contacting the image area of the web, said central portion being spaced from the web so as to not contact the image and non-image areas of the web.

8. A web winding apparatus for winding a web of material, comprising:

a core about which the web material is wound, said core being freely rotatable about an axis;

a roller mounted for rotation about an axis substantially parallel to said axis of said core, said roller having first and second axial ends, said roller including first and second end portions located at said first and second axial ends, respectively, and a central portion intermediate said first and second end portions, said first and second end portions having a first outer diameter D, said central portion having a second outer diameter d less than said first outer diameter D, said first and second end portions being comprised of a resilient outer layer supported on a rigid support member, said resilient outer layer having a hardness of about 40 to about 80 durometer Shore A;

urging means for urging contact between said roller and said core;

a first nip area formed by said first end portion and said core;

a second nip area formed by said second end portion and said core; and driving means for driving said roller to transport the web through said first and second nips to wind the web on said core such that the web contacts said first and second end portions and the web is spaced apart from said central portion.

9. The apparatus according to claim 8 wherein said resilient outer layer has a hardness of about 50 to about 64 durometer Shore A.

10. The apparatus according to claim 8 wherein said first and second end portions have a longitudinal length L, and a value of (D−d) is less than or equal to L.

11. The apparatus according to claim 8 wherein said roller has a length directed along said axis of said roller, and said central portion has a length directed along said axis of said roller, a ratio of said central portion length to said roller length being between about 0.25 and about 0.85.

12. A web winding apparatus for winding a web of material, comprising:

a core about which the web material is wound, said core being freely rotatable about an axis;

a roller mounted for rotation about an axis substantially parallel to said axis of said core, said roller having first and second axial ends, said roller including first and second end portions located at said first and second axial ends, respectively, and a central portion intermediate said first and second end portions, said first and second end portions having a first outer diameter D, said central portion having a second outer diameter d less than said first outer diameter D, said first and second end portions being comprised of a resilient outer layer supported on a rigid support member, said resilient outer layer having a thickness t in the range from 0.093 inches to about 0.2 inches;

urging means for urging contact between said roller and said core;

a first nip area formed by said first end portion and said core;

a second nip area formed by said second end portion and said core; and driving means for driving said roller to transport the web through said first and second nips to wind the web on said core such that the web contacts said first and second end portions and the web is spaced apart from said central portion.

13. The apparatus according to claim 12 wherein said thickness t is about 0.125 inches.

* * * * *

UNITED STATES PATENT AND TRADEMARK OFFICE

CERTIFICATE OF CORRECTION

PATENT NO. : 5,934,603

DATED : August 10, 1999

INVENTOR(S) : Kevin A. Cole, et al.

It is certified that error appears in the above-identified patent and that said Letters Patent is hereby corrected as shown below:

Title Page of Patent, Attorney Name
delete "Susan L. Patrick" and insert --Susan L. Parulski--.

Signed and Sealed this

Twenty-ninth Day of February, 2000

*Attest:*

Q. TODD DICKINSON

*Attesting Officer*

*Commissioner of Patents and Trademarks*